United States Patent [19]

Lindner et al.

[11] 4,126,019

[45] Nov. 21, 1978

[54] PATTERNING APPARATUS FOR PILE KNITTING MACHINES, PARTICULARLY FOR PRODUCING JACQUARD PATTERNED KNITTED PILE FABRICS ON CROCHETING GALLOON MACHINES

[75] Inventors: Heinz Lindner, Geyer/Erzg.; Wolfgang Georgi; Lisbet Müller, both of Tannenberg; Fritz Stopp; Werner Oehm, both of Geyer/Erzg., all of Germany

[73] Assignee: VEB Wirkmaschienbau, Karl Marx Stadt, Germany

[21] Appl. No.: 833,782

[22] Filed: Sep. 15, 1977

[30] Foreign Application Priority Data

Sep. 22, 1976 [DE] Fed. Rep. of Germany ..... 0419492

[51] Int. Cl.[2] ..... D04B 23/06; D04B 23/08; D04B 23/10; D04B 23/12

[52] U.S. Cl. ..... 66/84 R

[58] Field of Search ..... 66/203, 204, 91, 90, 66/104, 109

[56] References Cited

U.S. PATENT DOCUMENTS

| | | | |
|---|---|---|---|
| 3,857,260 | 12/1974 | Zwingen | 66/84 R |
| 3,913,355 | 10/1975 | Lindner | 66/84 R |
| 4,031,717 | 6/1977 | Lindner | 66/84 R |

*Primary Examiner*—Ronald Feldbaum
*Attorney, Agent, or Firm*—Nolte & Nolte

[57] ABSTRACT

The invention produces jacquard-patterned knitted pile fabrics on pile knitting machines, more particularly crocheting galloon machines in which sinkers for reliably selecting respective patterning pile thread are provided together with non pattern thread diverting surfaces.

7 Claims, 6 Drawing Figures

PATTERNING APPARATUS FOR PILE KNITTING MACHINES, PARTICULARLY FOR PRODUCING JACQUARD PATTERNED KNITTED PILE FABRICS ON CROCHETING GALLOON MACHINES

PRIOR ART

Patterning devices are known which produce jacquard-patterned knitted pile fabrics on crocheting galloon machines and which comprise a row of slide needles, a bar providing eye-pointed or feed needles for delivering knitting threads to the slide needles, at least one filling bearing, horizontally and vertically adjustable pile thread guides having several thread emerging openings situated in parallel to the longitudinal axis of the needles, one thread-selecting plate bar or sinker for each pile thread guide, the end of which that is adaptable to the thread emerging openings of the pile thread guide being provided with a thread "neck" for choosing the patterning pile thread and a vertically movable bar whereon all thread selecting plate bars are hingedly positioned and are lockable in a number of tilting or swinging positions which correspond to the number of thread emerging openings of the pile thread guide (German Pat. No. 119,275, U.S. Pat. No. 4,031,717). With the aid of this device, the pile threads tied up in a first wale are transported to the adjacent needle by means of the pile thread guide and the thread selecting plate bar lays only the pile thread intended for patterning, into the needle head of this needle. The patterning pile thread is developed by stitching it with the knitting thread during the return of the needle, while the non-patterning pile threads remain tied up in the first wale as a so-called stationary filling or weft. In the following machine run, the pile thread guide is set back by two needle divisions and lowered to the level of the needle which makes it possible to bind the patterning pile thread which was selected during the first machine run by the thread selecting plate bar, again into the first wale. Since a pile sinker in the form of a plate bar is situated between the two indicated needles, the respective patterning pile thread is formed into a pile loop.

The disadvantage of the just described device, however, is that when more than two pile threads are used per wale, no reliable selection of the patterning pile thread can be achieved. Due to the fact that the pile threads not intended for patterning assume a not exactly defined flow extending from the last binding place in the fabric up to the respective emerging opening of the pile thread guide, adverse conditions occur; for instance, during the selection of the pile thread coming from the innermost emerging opening of the pile thread guide, which thread is intended as a patterning pile, the pull exerted upon the patterning pile thread, selected by the thread selecting sinkers, can sometimes cause the pile threads not intended for patterning to reach the vicinity of the open hook of the needle and becomed meshed together.

This negative effect increases with the increase in threads to be employed since, in such a case, a piercing of individual capillaries by the hook of the needle suffices to produce patterning errors or thread breakages.

OBJECT OF THE INVENTION

It is therefore, an object of the invention to eliminate such functioning disruptions and to increase the productivity as well as the patterning capacity of the machine.

DESCRIPTION OF THE INVENTION

The invention is based on the objective to provide in a patterning device constructed in the known manner, a reliable selection of the patterning pile thread and to make the described patterning device suitable for operating with more than two pile threads per wale.

To this end and in accordance with the invention, the thread selecting sinker is provided with at least one edge which diverts the non-patterning pile threads from the shaft of the needle that loops the patterning pile threads, the vertical range of movement of this edge reaches from the emergence of the ends of the pile thread guide located in its uppermost position, to the lower edge of the needle, while the horizontal range of movement of the edge reaches from one emerging opening of the pile thread guide up to the immediately adjacent thread emerging opening.

In accordance with another feature of the invention, the number of such edges corresponds to the number — reduced by " 1" —of the thread emerging openings of the multiple pile thread guide.

In another embodiment of the invention, the non-patterning pile thread diverting edges are situated in unilaterally open recesses which are disposed between the thread neck and the side of the thread selecting sinker facing away from the filling placer.

In accordance with yet another feature of the invention, the side of the thread selecting sinker which faces away from the filling placer is provicded with the diverting edge.

EMBODIMENT EXAMPLE OF THE INVENTION:

The invention will now be described with reference to the accompanying drawing, wherein.

Figure 1:
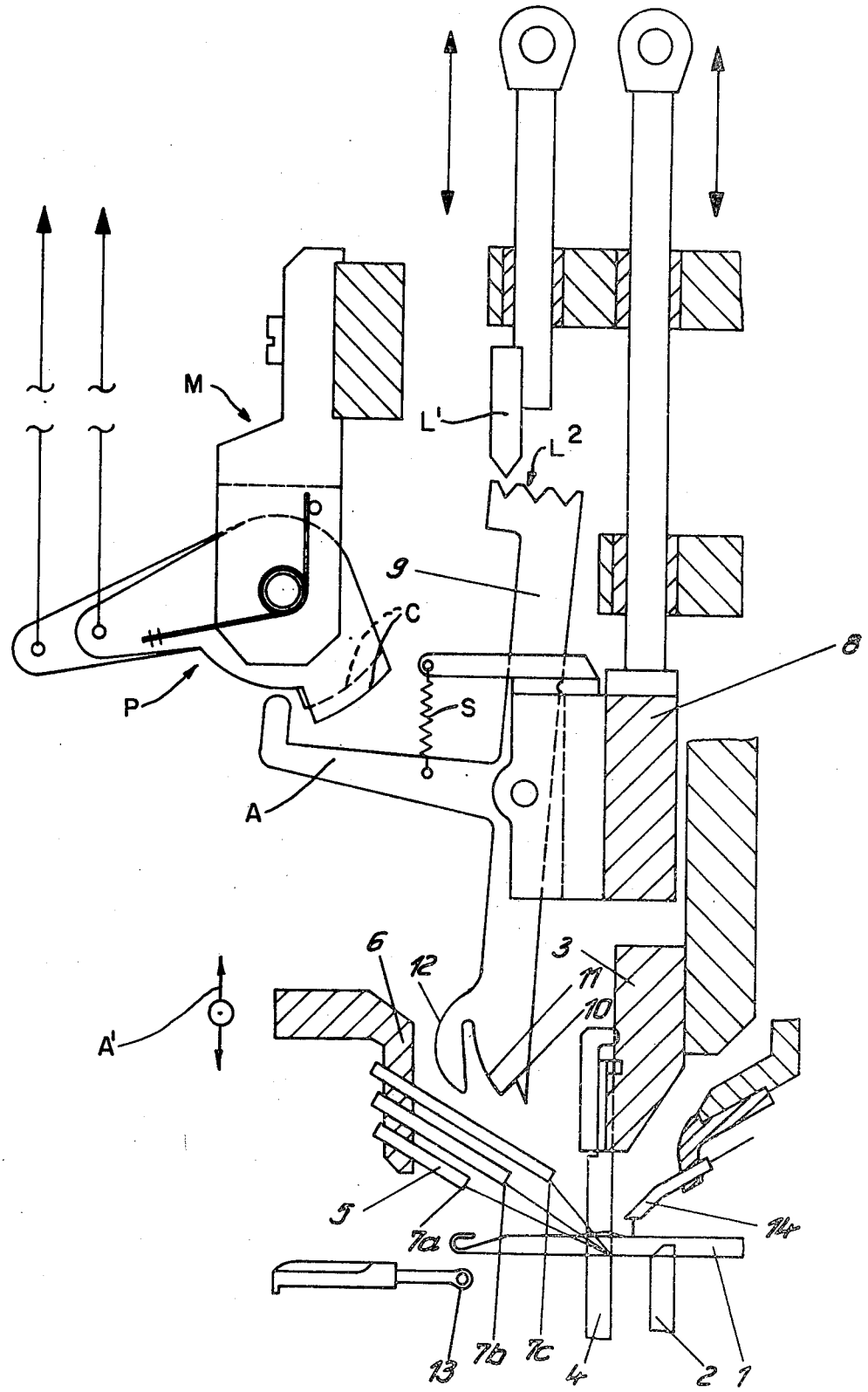
FIG. 1 is a partial cross-sectional view through a crocheting galloon machine provided with the patterning device of the invention.

The crocheting galloon machine is equipped with horizontally movable slide needles 1, controlled in a known manner by the taken-up loops, alone (see U.S. Pat. No. 4,043,153). The slide needles 1 are guided in the knocking over comb 2 and pass between the pile sinkers 4 which are affixed along the stationary bar 3 and are pointed downwardly. Directly ahead of the pile sinkers 4, are the multiple pile thread guides 5, disposed in a bar 6. The bar 6 is movable vertically as well as laterally in the direction of the row of needles as indicated by arrow $A^1$. The thread emerging openings *7a, b, c* of the pile thread guides 5 are disposed in an approximately horizontal plane. Above each multiple pile thread guide 5, one thread selecting sinker 9, respectively, is disposed on a guide bar 8 which is movable only in vertical direction. Each thread selecting sinker 9 is situated in its upper position above the multiple pile thread guide 5. The thread selecting sinker 9 is hingedly positioned intermediate its ends on the bar 8, so that its lower end with the thread neck 10 can be selectively coordinated to (disposed over) one of the thread emerging openings *7a, b, c,* of the multiple pile thread guide 5 to lay the thread therefrom over the respective slide needle.

Known sinker positioning means are provided comprising spring biased positioner elements P having cam surfaces C disposed on appropriate mounting means M and which are rotatable to operate positioning arm A against spring S to position sinker 9, and lock members $L^1$ and $L^2$ cooperate to stabilize the pattern position of the sinker.

For a reliable selection of the desired patterning pile thread, the thread selecting sinker 9 is also provided with two edges 11, 12 which, if necessary, divert the non-patterning pile threads from the shaft of the needle 1 which loops the patterning pile threads. As the sinker 9 is depressed to loop the patterning pile, the vertical extension of the edges 11, 12 reaches during this time, from the emerging openings 7 of the pile thread guide 5 situated in its uppermost position, up to the lower edge of the needle and the horizontal extension reaches from one of the emerging openings *7a, 7b* or *7c* up to the immediately adjacent emerging opening.

It is noted that in the apparatus disclosed, the conventional warp thread layering member 13 and the filling thread layering member 14 are also provided, for producing the goods (FIG. 1).

Figure 6:
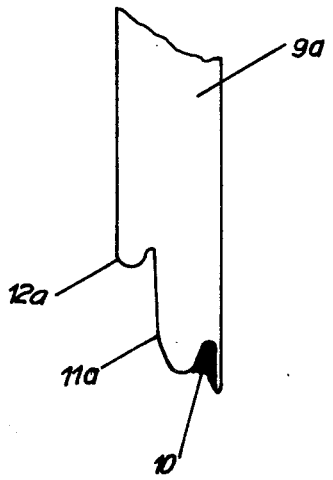
FIG. 6 is a side view of another embodiment of the thread selecting sinker of the invention.

In another embodiment of the thread selecting sinker *9a* (FIG. 6), the diverting edge *12a* is shortened in its horizontal and vertical extension on the side of the thread selecting sinker *9a* that is facing away from the filling thread layering member 14. In order to avoid piercing the capillaries of the pile threads, the junction between the thread neck 10 and the directly adjacent recess of the thread selecting sinker 9 which contains the diverting edge *11a,* is made round. Likewise, the junction between said recess and the edge *12a* is also rounded and edge *12a* is reduced in size; i.e. shortened.

At the start of the work cycle, the lower end of the thread selecting sinker 9 with the thread neck 10, may be located above the thread emerging opening of the desired patterning pile thread, for example thread emerging opening *7a,* whereby the pile thread guide is in its raised position. The guide bar 8 sinks downward and the thread selecting sinker 9 grasps with its thread neck 10 the pile thread which, in this instant, comes from the thread emerging opening *7a,* and presses the same on the shaft of the appropriate needle 1. During the return of the needle 1, this pile thread is then formed into a loop, while the pile threads which stem from the thread emerging openings *7b* and *7c* are not looped as they have not been pressed on the shaft of the needle.

Figure 2:
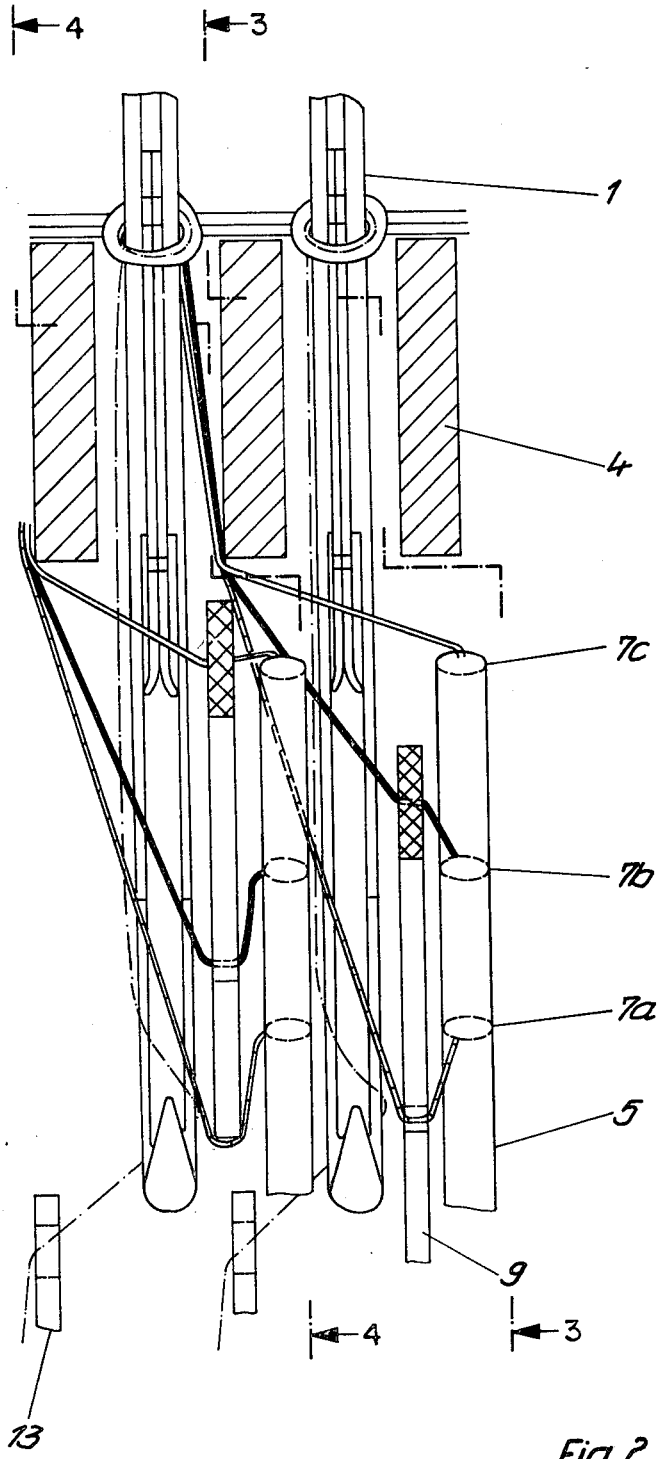
FIG. 2 is a partial top view upon the stitch forming elements of the crocheting galloon machine provided with the patterning device of the invention, according to FIG. 1.
Figure 3:
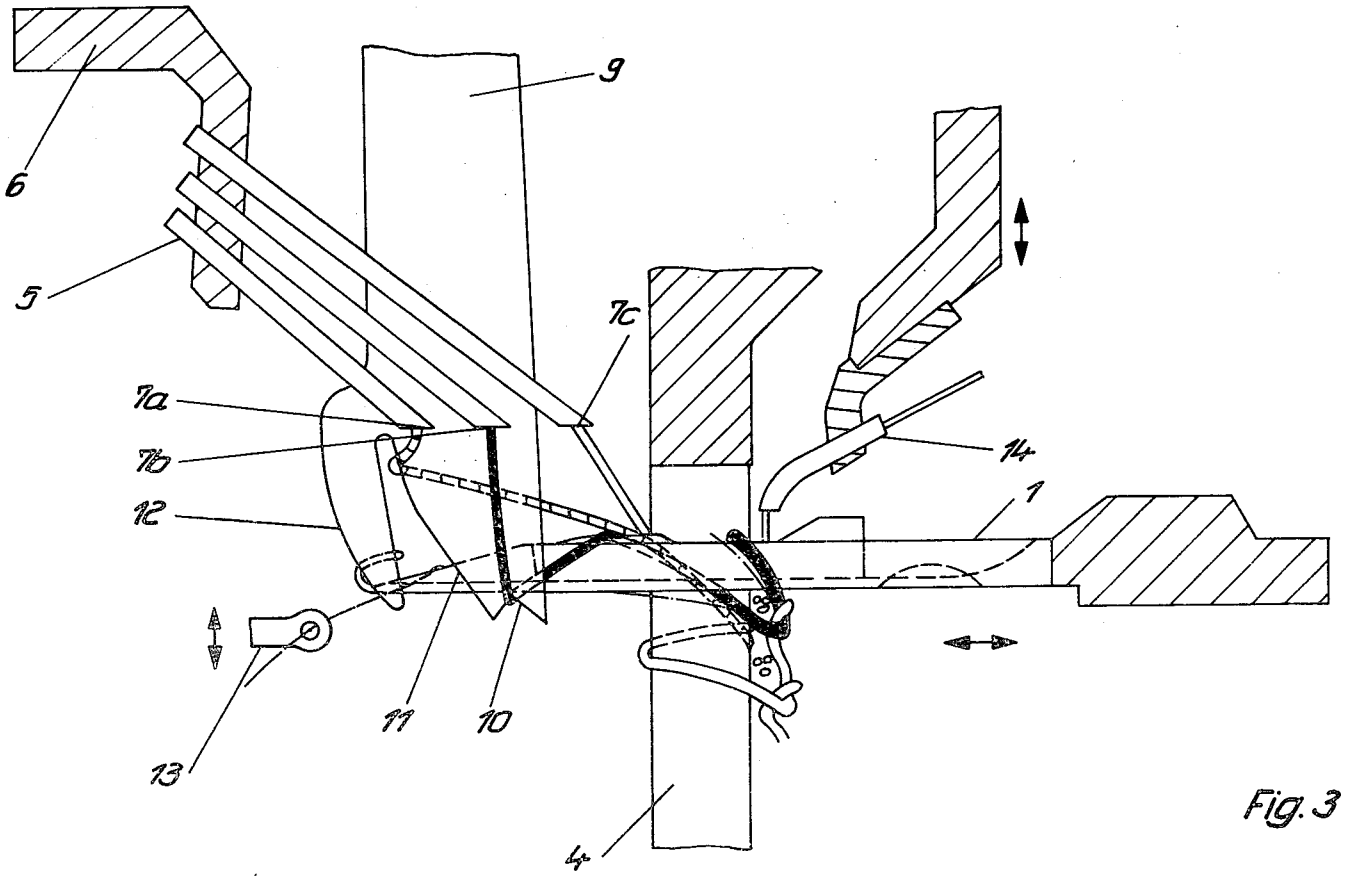
FIG. 3 is a section along line 3—3 of FIG. 2, in a reduced scale.
Figure 5:
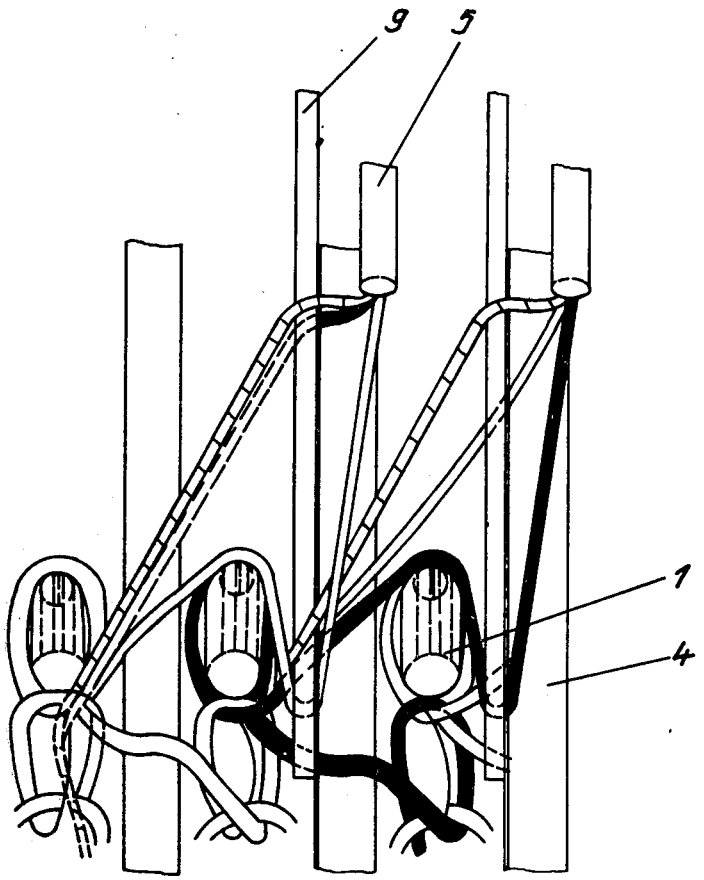
FIG. 5 is the front view of the stitch forming elements of FIG. 2 in an enlarged scale.

If the pile thread coming from thread emerging openings *7b* is to be looped, then the thread selecting sinker 9 stands with its neck 10 above the thread emerging opening *7b* and presses the appropriate pile thread upon the shaft of the appertaining or coordinated needle 1. The pile thread coming from thread emerging opening *7a* slides thereby, during the lowering of the thread selecting sinker 9, along the edge 11 into the recess of the thread selecting sinker 9, which assures the prevention of the pull exerted by the thread selecting sinker against the patterning pile thread, causing the pile thread coming from the thread emerging opening *7a* to reach the vicinity of the needle hook 1 and become looped (FIGS. 2, 3 and 5).

Figure 4:
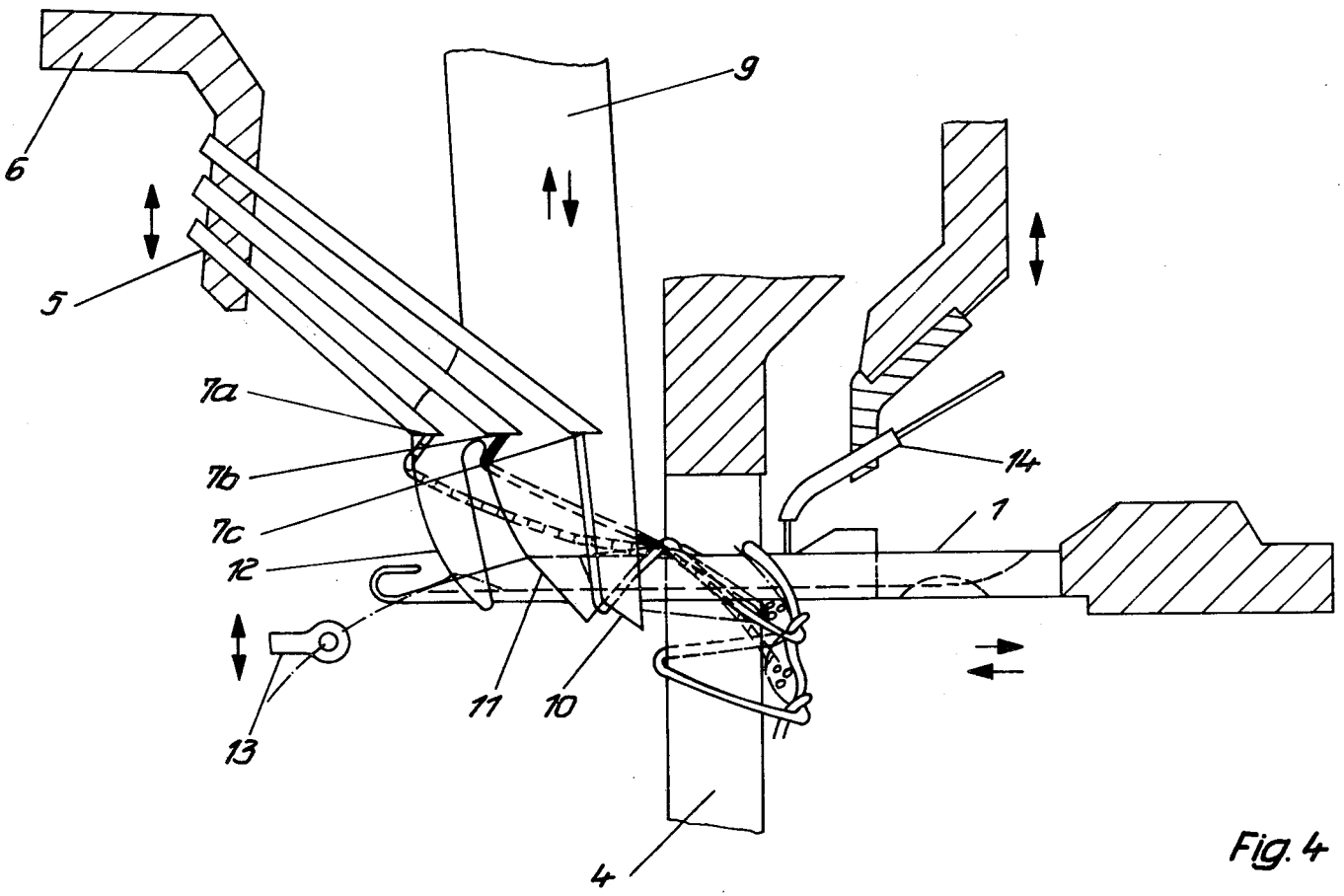
FIG. 4 is a section along 4—4 of FIG. 2, in a reduced scale.

If, however, the pile thread stemming from the thread emerging opening *7c* is to be looped, the thread selecting sinker 9 with its neck 10 will be positioned above the thread emerging opening *7c* and press the respective (appropriate) pile thread upon the shaft of the coordinated needle 1. The pile thread coming from thread emerging opening *7b* slides thereby, during the lowering of the thread selecting sinker 9, along the edge 11 into the recess of the thread selecting sinker 9 and the pile thread which comes from the thread emerging opening *7a* slides thereby, during the lowering of the thread selecting sinker 9, upwardly along edge 12 into the recess of the thread selecting sinker 9. As a result, the pile thread coming from the thread emerging opening *7a* as well as the one coming from the thread emerging opening *7b,* is diverted upwardly and sideways from the shaft of the respective needle 1 so that, with reliability, only the pile thread intended for patterning will be grasped by the hook during the return of the needle and become looped (FIGS. 2, 4 and 5).

We claim:

1. A patterning device for pile knitting machines, particularly for producing jacquard-patterned knitted pile fabrics on crocheting galloon machines, comprising a row of slide needles, horizontally and vertically adjustable pile thread guides having a plurality of thread emerging openings parallel to the longitudinal axes of the needles for delivering patterning and non-patterning threads, a thread selecting sinker for each pile thread guide, means for disposing said sinker relative to said thread emerging openings of the respective pile thread guide, said sinker having a thread neck for the patterning pile thread, said disposing means including a vertically movable sinker bar whereon all thread selecting sinkers are hingedly disposed; characterized in that the thread selecting sinkers (9) are provided with at least one edge (11, 12) which positively diverts the non-patterning pile threads from the shaft of the needle (1).

2. The patterning device of claim 1, in which the vertical range of movement of said edge reaches from the exit ends of said pile thread guide (5) to the lower edge of the needle (1) and the horizontal range of movement of said edge reaches from one emerging opening (7) to the immediately adjacent emerging opening.

3. The patterning device of claim 1, wherein the number of the diverting edges (11, 12) corresponds to the number —reduced by "1"— of thread emerging openings (7) of the multiple pile thread carrier.

4. The patterning device of claim 1, in which the knitting machine includes a filling layering member and wherein the diverting edges (11, 12) are disposed between the thread neck (10) and the side of the thread selecting sinker (9) facing away from the filling layering member (14).

5. The patterning device of claim 4, wherein the diverting edge (12a) on the side of the thread selecting sinker (9a) which faces away from the filling layering member (14), is shortened in its horizontal and vertical extension.

6. The patterning device of claim 4, wherein the diverting edges are situated in the recesses.

7. The patterning device of claim 6, wherein the junction between the thread neck (10) and the immediately adjacent recess and from there to each further recess, are round.

* * * * *